US011253029B2

(12) United States Patent
Cooper

(10) Patent No.: US 11,253,029 B2
(45) Date of Patent: Feb. 22, 2022

(54) SLOTTED EYELET

(71) Applicant: NIKE, Inc., Beaverton, OR (US)

(72) Inventor: Aaron A C Cooper, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 383 days.

(21) Appl. No.: 16/244,017

(22) Filed: Jan. 9, 2019

(65) Prior Publication Data

US 2019/0246743 A1 Aug. 15, 2019

Related U.S. Application Data

(60) Provisional application No. 62/628,766, filed on Feb. 9, 2018.

(51) Int. Cl.
*A43C 5/00* (2006.01)
*A43B 23/02* (2006.01)

(52) U.S. Cl.
CPC ..... *A43C 5/00* (2013.01); *A43B 23/0245* (2013.01)

(58) Field of Classification Search
CPC .... A43C 1/04; A43C 5/00; A43C 1/00; A43C 11/00; A43B 23/0245
USPC ..... 36/50.1; 24/68 SK
See application file for complete search history.

(56) References Cited

U.S. PATENT DOCUMENTS 4,553,342 A * 11/1985 Derderian ..... A43C 1/00 24/712
6,029,376 A 2/2000 Cass
6,513,210 B1 2/2003 Gonzalez
8,490,299 B2 7/2013 Dua et al.
8,800,172 B2 8/2014 Dua et al.
8,819,963 B2 9/2014 Dojan et al.
8,973,410 B1 3/2015 Podhajny
D734,017 S 7/2015 Avar et al.
9,072,335 B1 7/2015 Podhajny
9,107,478 B2 8/2015 Dekovic et al.
9,113,674 B2 * 8/2015 Dojan ..... A43B 23/0235
(Continued)

FOREIGN PATENT DOCUMENTS

CN 202233365 U 5/2012
CN 104981176 A 10/2015
(Continued)

OTHER PUBLICATIONS

Solereview, "Nike Air Zoom Odyssey 2 Review," retrieved from: https://www.solereview.com/nike-air-zoom-odyssey-2-review/, dated Nov. 30, 2016, 19 pages.

*Primary Examiner* — Jameson D Collier
(74) *Attorney, Agent, or Firm* — Klarquist Sparkman, LLP

(57) ABSTRACT

An article of footwear includes a sole structure, an upper, a slotted eyelet, an opening, and a tensile strand. The upper is coupled to the sole structure and has a medial portion and a lateral portion. The slotted eyelet is formed in the medial portion or the lateral portion and has a major axis and a minor axis. A length of the slotted eyelet along the major axis is larger than a width of the slotted eyelet along the minor axis. The opening is formed in the medial portion or the lateral portion, and the opening is spaced apart from the slotted eyelet. The tensile strand has a first portion and a second portion. The first portion extends through the opening and defines an aperture adjacent the slotted eyelet, and the second portion extends from the first portion toward the sole structure.

20 Claims, 6 Drawing Sheets

(56) References Cited

U.S. PATENT DOCUMENTS

| | | | | |
|---|---|---|---|---|
| 9,420,850 | B2 | 8/2016 | Dojan et al. | |
| 9,474,331 | B2 | 10/2016 | Waatti | |
| 9,545,128 | B2 | 1/2017 | Podhajny et al. | |
| 9,681,706 | B2 * | 6/2017 | Dojan | A43C 11/002 |
| 10,136,701 | B2 * | 11/2018 | Klein | A43B 3/126 |
| 11,006,697 | B2 * | 5/2021 | Cooper | A43B 5/00 |
| 2005/0217089 | A1 | 10/2005 | Lin | |
| 2007/0294868 | A1 | 12/2007 | Gnatenko | |
| 2010/0154256 | A1 | 6/2010 | Dua | |
| 2013/0019500 | A1 | 1/2013 | Greene | |
| 2013/0145652 | A1 | 6/2013 | Podhajny | |
| 2014/0245633 | A1 | 9/2014 | Podhajny | |
| 2016/0058100 | A1 * | 3/2016 | Dealey | D04B 1/22<br>36/84 |
| 2016/0120264 | A1 | 5/2016 | Bardini et al. | |
| 2016/0331083 | A1 | 11/2016 | Uesato | |
| 2016/0331084 | A1 | 11/2016 | Xanthos et al. | |
| 2017/0020231 | A1 | 1/2017 | Hausmann et al. | |
| 2017/0202296 | A1 | 7/2017 | Fuerst et al. | |
| 2019/0246742 | A1 * | 8/2019 | Cooper | A43C 1/04 |

FOREIGN PATENT DOCUMENTS

| | | | | |
|---|---|---|---|---|
| EP | 2949457 | A1 * | 12/2015 | A43C 1/04 |
| FR | 3019009 | A1 | 5/2016 | |
| GB | 665958 | A | 2/1952 | |
| WO | WO-2009/148901 | A1 | 12/2009 | |
| WO | WO 2014/124071 | A1 | 8/2014 | |

* cited by examiner

SLOTTED EYELET

CROSS-REFERENCE TO RELATED APPLICATION

This application claims the benefit of U.S. Provisional Application No. 62/628,766, filed Feb. 9, 2018, which is incorporated by reference herein.

FIELD

This disclosure relates generally to closure systems for articles of footwear.

BACKGROUND

Articles of footwear, such as shoes, typically include a closure system that can be opened or loosened to allow a wearer to insert a foot into the article. The closure system can then be closed or tightened to secure the article to the wearer's feet. Some closure systems include laces, straps, strands, and/or cords that are used to adjust the closure system and/or to provide additional support or reinforcement to the article.

DETAILED DESCRIPTION

General Considerations

Figure 1:
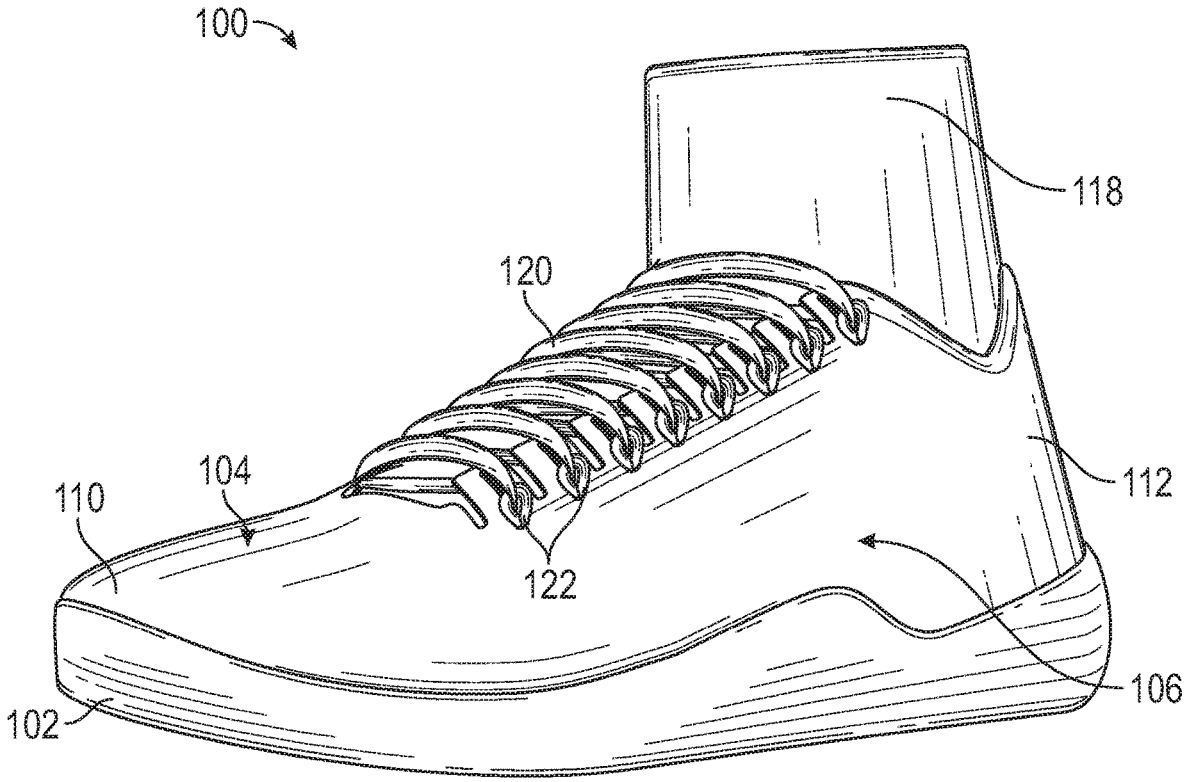
FIG. 1 is a perspective view of an exemplary embodiment of an article of footwear.

For purposes of this description, certain aspects, advantages, and novel features of the embodiments of this disclosure are described herein. The present disclosure is directed toward all novel and nonobvious features and aspects of the various disclosed embodiments, alone and in various combinations and sub-combinations with one another. Features, dimensions, characteristics, or groups described in conjunction with a particular aspect, embodiment or example are to be understood to be applicable to any other aspect, embodiment or example described herein unless incompatible therewith. The disclosed methods, systems, and apparatus are not limited to any specific aspect, feature, or combination thereof, nor do the disclosed methods, systems, and apparatus require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

The explanations of terms and abbreviations herein are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

As used herein, the term "and/or" used between the last two of a list of elements means any one or more of the listed elements. For example, the phrase "A, B, and/or C" means "A," "B," "C," "A and B," "A and C," "B and C," or "A, B, and C."

As used herein, the term "coupled" generally means physically coupled or linked and does not exclude the presence of intermediate elements between the coupled items absent specific contrary language.

As used herein, the terms "articles of footwear" or "articles" mean any type of footwear, including, for example, running shoes, soccer shoes, football shoes, rugby shoes, basketball shoes, baseball shoes, sneakers, hiking boots, sandals, socks, etc.

As used herein "rectangular" means that a first dimension (e.g., a width) is greater than a second dimension (e.g., a thickness) of an object. "Rectangular" includes configurations that are substantially rectangular, e.g., vertexes are rounded so as to have certain radiuses of curvature or sides are loosely curved, and the configuration on the whole is rectangular.

As used herein "circular" means having the form of a circle and includes configurations that are substantially circular (e.g., ovular).

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the following description and the claims.

Introduction to the Disclosed Technology

Closure systems for articles of footwear ("articles") can include laces that are interwoven through a plurality of eyelets. Some closure systems can include more than one set of eyelets. For example, a closure system can have a first set of eyelets that include eyelets disposed on the medial side portion and eyelets disposed on the lateral side portion of the article. In some instances, the first set of eyelets can be adjacent to a tongue of the article. The article can also include a second set of eyelets that are disposed on the medial and lateral side portions of the article adjacent to the first set of eyelets. The second set of eyelets can, for example, be coupled to or integrally formed with tensile strands, which provide additional adjustability to the closure system and/or support to the wearer's foot. The lace can extend through each eyelet of the first and second sets of eyelets.

The interaction between and/or the configuration of the lace, the first set of eyelets, and/or the second set of eyelets can affect the fit and feel of the article on the wearer's foot, as well as affect the wearer's ability to adjust the closure system. For example, configuring the first set of eyelets such that the openings of the first set of eyelets are elongate or slotted can improve the interaction between the lace member and the first and second set of eyelets, which in turn can improve the fit and feel of the articles on the wearer's feet.

Described below are various embodiments of articles with slotted eyelets that can, for example, provide at least one of the above-mentioned advantages.

EXEMPLARY EMBODIMENTS

In one representative embodiment, an article of footwear comprises a sole structure, an upper, a slotted eyelet, an opening, and a tensile strand. The upper is coupled to the sole structure and has a medial portion and a lateral portion. The slotted eyelet is formed in the medial portion or the lateral portion and has a major axis and a minor axis. A length of the slotted eyelet along the major axis is larger than a width of the slotted eyelet along the minor axis. The opening is formed in the medial portion or the lateral portion, and the opening is spaced apart from the slotted eyelet. The tensile strand has a first portion and a second portion. The first portion extends through the opening and defines an aperture adjacent the slotted eyelet, and the second portion extends from the first portion toward the sole structure.

In some embodiments, the slotted eyelet is rectangular.

In some embodiments, the article of footwear further comprises a lace member that extends through the slotted eyelet and the aperture of the tensile strand. The slotted eyelet and the lace member are configured such that the lace member can move along the major axis of the slotted eyelet.

In some embodiments, the lace member comprises a width, and the width of the lace member is less than the length of the slotted eyelet along the major axis.

In some embodiments, the lace member comprises a thickness, and the thickness of the lace member is slightly less than the width of the slotted eyelet along the minor axis.

In some embodiments, the opening is circular, and a diameter of the opening is aligned with the major axis of the slotted eyelet.

In some embodiments, the opening is located closer to the sole structure than the slotted eyelet.

In some embodiments, the first portion of the tensile strand forms a loop.

In some embodiments, the second portion of the tensile strand includes a first end and a second end, wherein the first end is spaced toward a forefoot region of the article of footwear relative to the second end.

In some embodiments, the second portion of the tensile strand is V-shaped.

In some embodiments, the first portion of the tensile strand has a first cross-sectional profile, and the second portion of the tensile strand has a second cross-sectional profile. The first and second cross-sectional profiles are different.

In some embodiments, the first cross-sectional profile is circular, and the second cross-sectional profile is rectangular.

In some embodiments, the slotted eyelet is one of a plurality of slotted eyelets formed in the medial and lateral portions of the upper, the opening is one of a plurality of openings formed in the medial and lateral portions of the upper, and the tensile strand is one of a plurality of tensile strands. Each of the openings is disposed adjacent a respective slotted opening, and the first portion of each of the tensile strands extends through a respective opening.

In another representative embodiment, an article of footwear comprises a sole structure, an upper, a plurality of slotted eyelets, and a plurality of tensile strands. The upper is coupled to the sole structure and has a medial portion and a lateral portion. The slotted eyelets are formed in the medial and lateral portions of the upper, each having a major axis and a minor axis. Each slotted eyelet has a width along the major axis that is larger than a thickness along the minor axis. The openings are formed in the medial and lateral portions of the upper, and the openings are spaced apart from respective slotted eyelets. The tensile strands have first portions and second portions. The first portions extend through respective openings and define apertures adjacent respective slotted eyelets, and the second portions extend from respective first portions toward the sole structure.

In some embodiments, the first portions of the tensile strands form loops, and the article further comprises a lace. The lace extends through the slotted eyelets and the loops.

In some embodiments, the tensile strands bias the lace towards an outermost edge of the slotted eyelets when the lace is in a loosened configuration.

In some embodiments, the lace moves the tensile strands and moves away from the outermost edge of the slotted eyelets and toward an innermost edge of the slotted eyelets when the lace is in a tightened configuration.

In some embodiments, a ratio of a width of one or more of the slotted eyelets to a width of the lace is 1.1-4.0 when the lace is in a relaxed configuration.

In some embodiments, a ratio of a width of one or more of the slotted eyelets to a width of the lace is 1.5-3.5 when the lace is in a relaxed configuration.

In some embodiments, a ratio of a thickness of one or more of the slotted eyelets to a thickness of the lace is 0.9-1.1 when the lace is in a relaxed configuration.

FIGS. 1-8 show an exemplary embodiment of an article of footwear 100 (which is also referred to herein as "the article 100") and its components. Referring to FIG. 1, the article 100 can include two main components: a sole structure 102 and an upper 104 coupled to the sole structure 102.

In the certain embodiments, the article 100 can take the form of an athletic shoe, such as a tennis shoe, a running shoe, or a basketball shoe. It should be noted, however, that the article can take various other forms, including hiking boots, skateboarding shoes, sandals, and other types of footwear.

In some embodiments, the sole structure 102 and the upper 104 can be formed as a single, integral structure. In other embodiments, the upper 104 can be coupled to the sole structure 102, as shown, for example, in the illustrated embodiment.

Generally, the upper 104 can be any type of upper. For example, in embodiments where the article 100 is a tennis shoe or a running shoe, the upper 104 can be a low-top upper. In embodiments where the article 100 is a basketball shoe, the upper 104 can be a high-top upper that is shaped to provide high support on a wearer's ankle.

Figure 2:
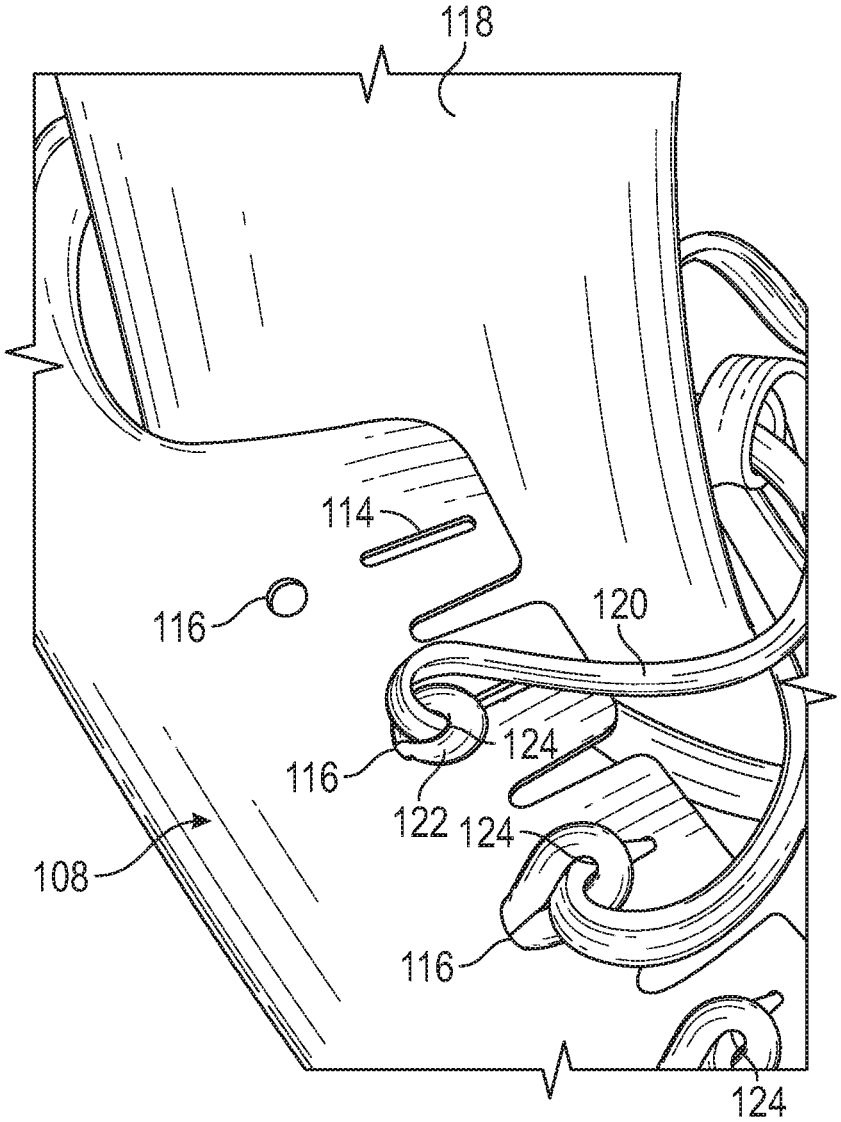
FIG. 2 is a detail view of a closure system of the article of footwear, showing the closure system partially unlaced.

The upper 104 can have a lateral side portion 106, a medial side portion 108 (FIG. 2), a toe portion 110, and a heel portion 112. Referring to FIG. 2, the upper 104 can also include one or more eyelets 114 and one or more openings 116 formed in the lateral and medial side portions 106, 108. The eyelets 114 and the openings 116 on the lateral side portion 106 can be spaced apart from the eyelets 114 and the openings 116 on the medial side portion 108. An optional sock liner 118 (and/or a tongue) can, in some embodiments, be disposed between the lateral side portion 106 and the medial side portion 108.

The article 100 can further comprise a lace (or primary lace) 120 and one or more tensile strands (or secondary laces) 122. The lace 120 and the tensile strands 122 together with eyelets 114 and openings 116 of the upper 104 can form a closure system of the article 100. The closure system can be opened or loosened such that the wearer can insert their foot into the article 100. The closure system can also be closed or tightened to secure the article 100 to the wearer's foot.

Figure 5:
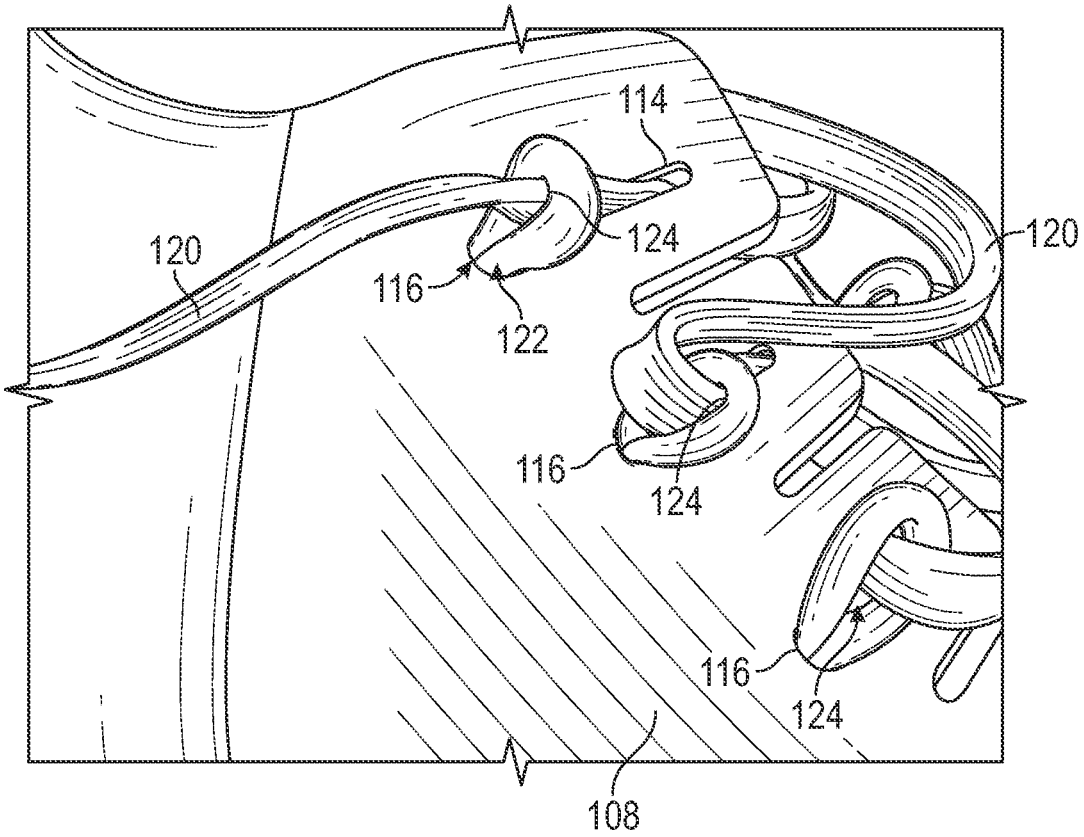
FIG. 5 is a detail view of a closure system of the article of footwear, showing the closure system fully laced and in a loosened configuration.

Referring now to FIGS. 2 and 5, the eyelets 114 can be configured for receiving the lace 120. The openings 116 can be configured for receiving the tensile strands 122. The tensile strands 122 can also define apertures or loops 124 through which the lace 120 can also extend.

The lace 120 can articulate relative to the eyelets 114 and/or the openings 116 to help accommodate various tensions of the lace 120 and/or the tensile strands 122. The configuration of the eyelets 114 and/or openings 116 can thereby provide improved adjustability, which can help accommodate various shapes and/or sizes of feet. This can be accomplished in several ways. For example, referring to FIGS. 6 and 7B, the eyelets 114 can define an elongate slot that has a width WS (FIG. 6) that is wider than a width WL (FIG. 7B) of the lace 120. As such, the lace 120 can move relative to the eyelet 114 as the lace 120 wraps around the tensile strands 122 at different angles depending on the tightness of the lace 120 and the tensile strands 122, the shape and size of the wearer's foot, and/or other factors.

Figure 8:
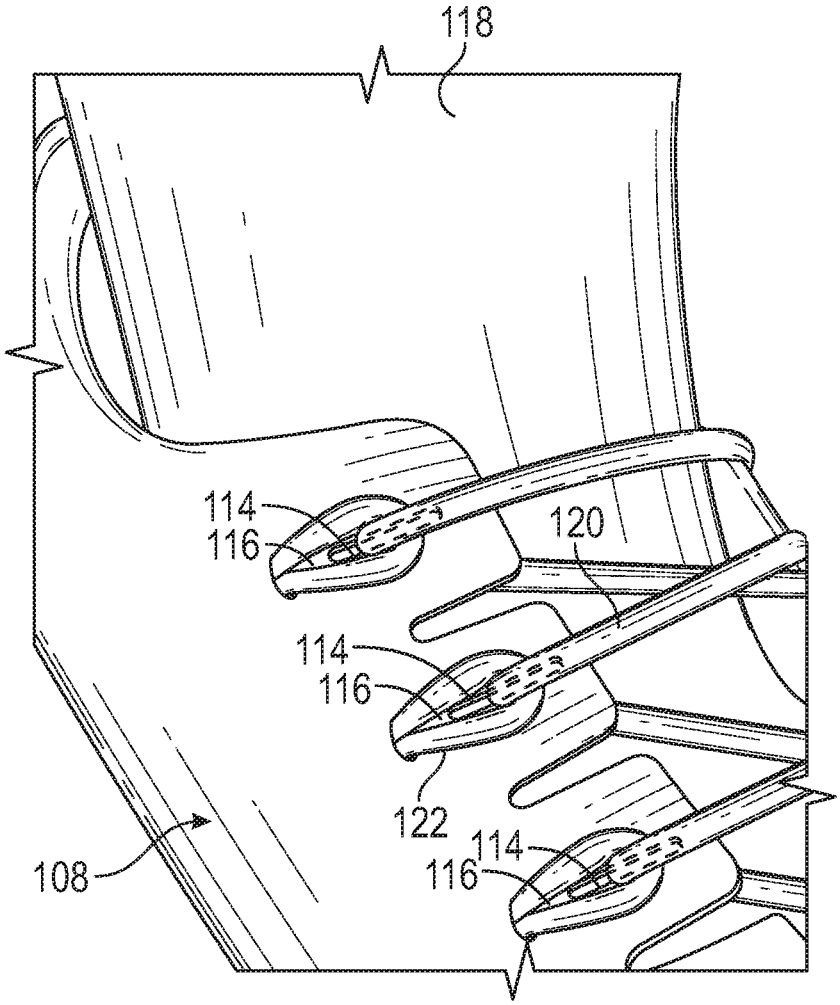
FIG. 8 is a detail view of a closure system of the article of footwear, showing the closure system fully laced and in a tightened configuration.

For example, referring to the uppermost eyelet 114 shown in FIG. 5, the eyelet 114 can be sized and/or configured such that the lace is spaced from the lateral (innermost) edge of the opening 116 (i.e., the right edge of the opening 116 in the orientation shown in FIG. 5) when the shoe is in a loosened configuration, a partially tightened configuration, and/or possibly a tightened configuration depending on the shape and/or size of the wearer's foot. One reason for this is that the tensile strand 122 can hold the lace 120 toward the medial (outermost) edge of the opening 116 (i.e., the left edge of the opening 116 in the orientation shown in FIG. 5). As the lace 120 and thus the tensile strand 122 is tightened, the lace 120 can move from a position at or near the medial (outermost) edge of the opening toward a position at or near the lateral (innermost) edge of the opening 116, as shown in FIG. 8.

Figure 6:
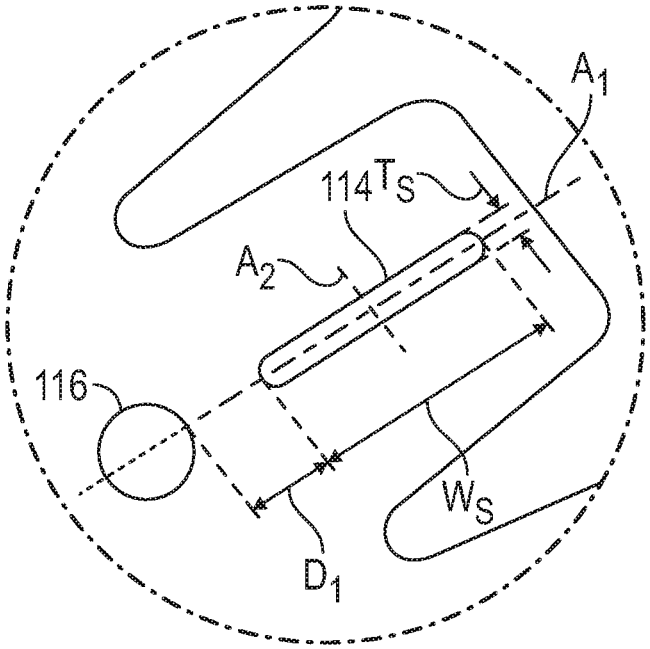
FIG. 6 is a detail view of a slotted eyelet and opening of the article of footwear.
Figure 7A:
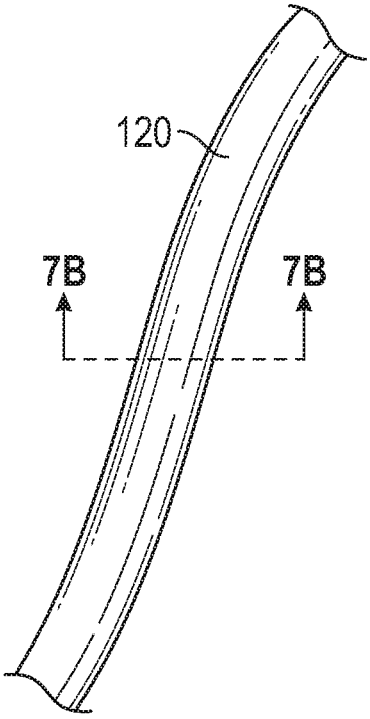
FIG. 7A is a perspective view of a lace of the article of footwear.
Figure 7B:
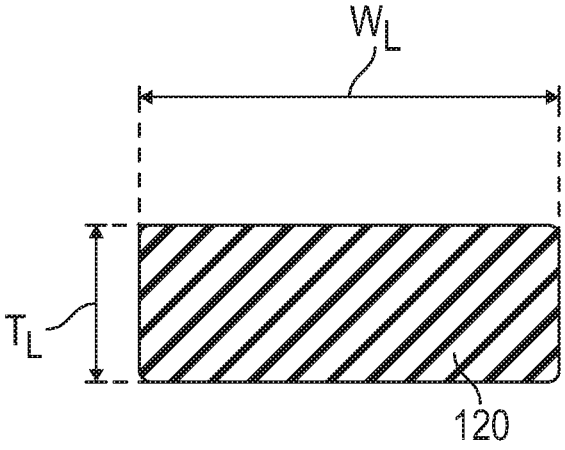
FIG. 7B is a cross-sectional view of the lace of the article of footwear.

As shown in FIG. 6, the slotted eyelet 114 can have a major axis A1 and a minor axis A2 that is perpendicular to the major axis A1. The width WS of the slotted eyelet 114 can be measured along the major axis A1. A thicknesses TS of the slotted eyelet 114 can be measured along the minor axis A2. As shown in FIG. 7B, the lace 120 can have a thickness TL and a width WL, as measured in a relaxed condition (i.e., without any external forces applied to the lace 120) or in a tensed condition. The thickness TS of the slotted eyelet 114 can be the same or substantially the same as a thickness TL of the lace 120. Accordingly, for rectangular laces (i.e., WL>TL), the lace 120 can slide relative to the slotted eyelet 114 along the major axis A1 but generally will not twist or otherwise adjust its position relative to the minor axis A2.

In certain embodiments, a ratio of the width WS of the slotted eyelet 114 to the width WL of the lace 120 can be 1.1-4.0 or, in some embodiments, 1.5-3.5.

In some embodiments, a ratio of the thickness TS of the slotted eyelet 114 to the thickness TL of the lace 120 can be 0.9-1.1 or, in some embodiments, 0.95-1.05.

The openings 116 can comprise various shapes such as circular, rectangular, ovular, triangular, star-shaped, etc. The openings 116 can be aligned with the major axis A1 of the slotted eyelet 114. For example, a center-point or midpoint of the opening 116 can be aligned with the major axis A1 of the slotted eyelet 114.

The openings 116 can be spaced from the slotted eyelet by a distance D1. In particular embodiments, the distance D1 can be 0.1-3.0 inches or 0.25-2.0 inches. In some embodiments, D1 can be greater than or equal to a length of the exposed portion of the tensile strand 122 when the tensile strand is in a relaxed condition.

In some embodiments, the slotted eyelets 114 can be used with articles that do not have tensile strands 122. For example, the slotted eyelets 114 can be used with an article that has loop or secondary eyelets that are formed in or coupled to the upper 104.

In lieu of or in addition to the slotted eyelets 114, a first portion of the upper 104 that is adjacent to the eyelets 114 can be formed from relatively flexible or elastic material, and a second portion of the upper 104 that is adjacent to the openings 116 can be formed from relatively stiff or inelastic material. As such, the eyelets 114 can translate relative to their respective openings 116 as the flexible material of the upper stretches when the lace 120 is tightened. In such embodiments the distance D1 can increase by 10-25% or 0.1-0.5 inches from when the lace 120 is slackened to when the lace is tightened.

Figure 3:
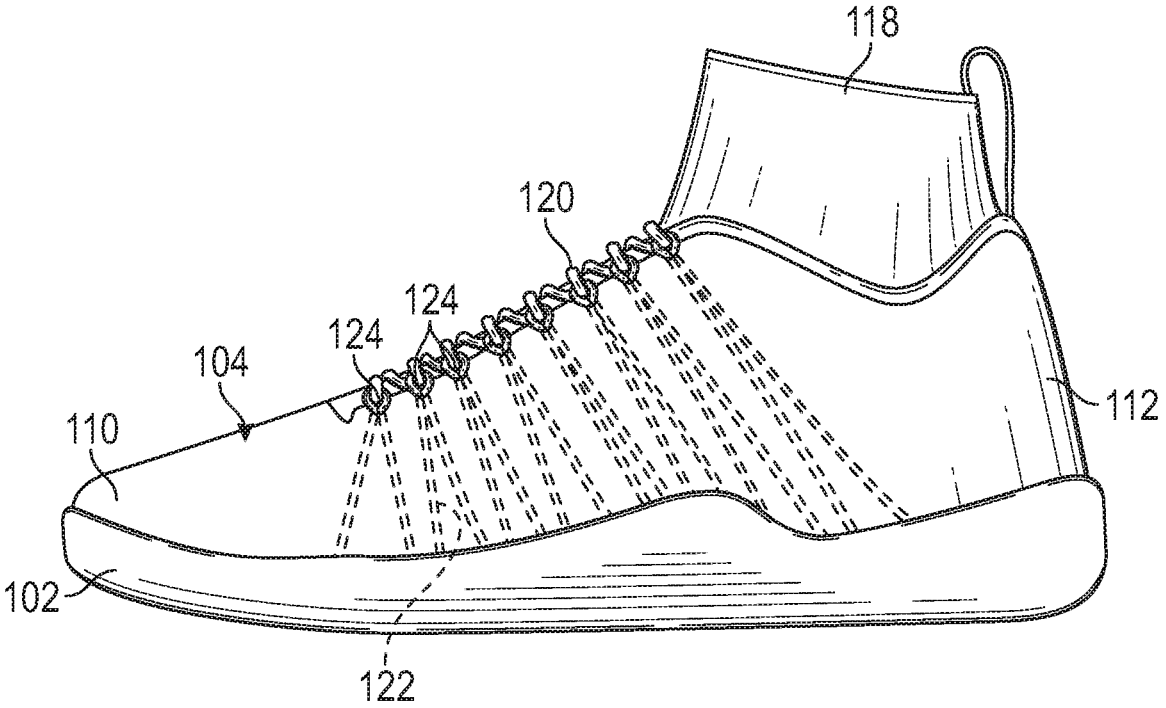
FIG. 3 is a side elevation view of the article of footwear, showing tensile strands in broken lines.
Figure 4:
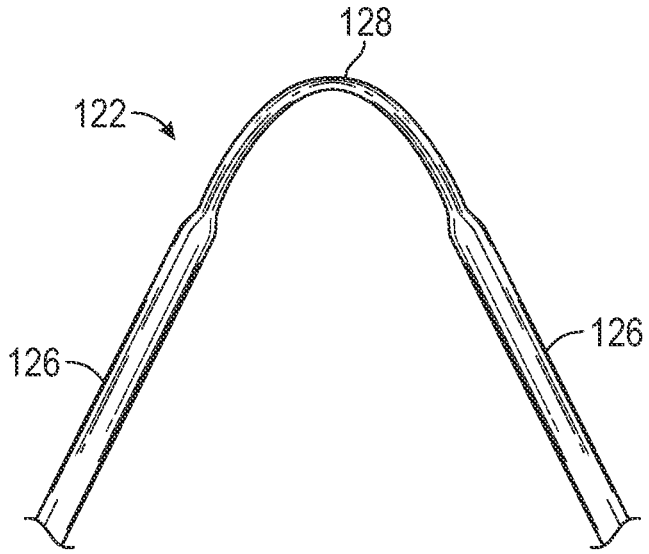
FIG. 4 is a detail view of a tensile strand of the article of footwear.

Referring to FIG. 3, the tensile strands 122 can be coupled to the sole structure 102 and/or a lower edge portion of the upper 104. The tensile strands 122 can extend upwardly from the sole structure 102 toward an upper edge portion of the upper (i.e., toward the openings 116). In some embodiments, the tensile strands 122 can extend along or adjacent to an interior surface of the upper 104 such that only a portion of the tensile strands 122 are exposed (e.g., the loops 124).

The tensile strands 122 can, for example, be formed of a relatively less stretchable material that the upper 104. As such, the tensile strands 122 can provide additional support to the wearer's feet. This additional support can, for example, be advantageous during activities (e.g., tennis, basketball, etc.) with frequent acceleration, deceleration, and/or direction changes.

In some embodiments, the tensile strands 122 can be V-shaped. The "legs" of the "V" can be coupled to the sole structure 102, and the "point" of the "V" can extend through the opening 116 of the upper 104. In certain embodiments, the legs of adjacent tensile strands can overlap.

In some embodiments, a separate tensile strand 122 can extend through each opening 116 of the upper 104 with an exposed portion forming the loops 124. In other words, an upper having sixteen openings (i.e., eight openings on the lateral side and eight openings on the medial side) can have 16 tensile strands, each extending from the sole structure 102 and through a respective opening 116 of the upper 104.

In another embodiment, loops or eyelets (e.g., similar to loops 124) can be coupled to the tensile strands (e.g., at ends of the tensile strands). In other embodiments, the loops or eyelets can be connected to the upper.

In other embodiments, one or more of the tensile strands 122 can extend through a plurality of openings 116 in the upper 104. For example, a first tensile strand can extend through each of the openings 116 on the lateral side portion 106 of the upper 104, and a second tensile strand can extend through each of the openings 116 on the medial side portion 108 of the upper 104. In such embodiments, each tensile strand 122 can extend from the sole structure 102, through a first opening in the upper 104, back to the sole structure, through a second opening in the upper, back to the sole structure, and so on. Stated another way, one tensile strand can zigzag between the sole structure 102 and the openings 116 that are disposed on the lateral side portion 106 of the upper 104, and another tensile strand can zigzag between the sole structure 102 and the openings 116 that are disposed on the medial side portion 108 of the upper 104. The tensile strands 122 can be secured to the sole structure 102 and/or the upper 104 at each end (i.e., toward the toe and heel portions) and/or at various intermediate locations.

As mentioned above, a portion of the tensile strands 122 can form the loops 124 that extend from the openings 116 and through which the lace 120 extends.

In particular embodiments, the tensile strands 122 can also have a plurality of portions or sections. One or more of those portions can have a different cross-sectional profile or shape than one or more other portions. For example, referring to FIG. 4, the tensile strands 122 can have two flat portions 126 (e.g., with a rectangular cross-sectional profile) and one rounded portion 128 (e.g., with a circular or annular cross-sectional profile) disposed between the flat portions 126. Providing tensile strands with different cross-sectional profiles along their length can, for example, improve the comfort the article on the wearer's foot and and/or improve the functionality of the closure system.

The flat portions 126 can be coupled to the sole structure 102 and can be sized and/or configured to extend along the interior (i.e., non-exposed) surface of the upper 104. In this manner, the flat portions 126 are disposed between the wearer's foot and the interior surface of the upper 104 when the wearer's foot is inserted into the article 100. The profile of the flat portions 126 of the tensile strands 122 can be relatively wide compared to the thickness. For example, the flat portions 126 of the tensile strands 122 can be ⅜-¾ inches wide and 1/32-1/16 inches thick. This flat profile can, for example, distribute load or pressure from the tensile strand 122 on the wearer's foot and upper over a wide area (and without adding undesirable bumps or bulges to the upper. Configuring the tensile strands 122 in this manner can, for example, improve the wearer's comfort and/or increase support to the wearer's foot.

The tensile strands 122 can be sized and/or configured such that the round portions 128 extend through the openings 116 and extend outwardly from an exterior surface of the upper 104. The circular or annular cross-sectional profile can, for example, allow the round portions 128 of the tensile strands 122 to more easily fit through and/or move relative to the openings 116 than a cross-sectional profile with edges or corners (e.g., rectangular, triangular, etc.). The round portions 128 of the tensile strands 122, which can include the loops 124, can also facilitate movement of the lace member 120 through the loops 124, thus improving the adjustability of the closure system of the article 100.

Accordingly, the tensile strands 122 that have a plurality of a plurality of portions with different cross-sectional profiles (e.g., flat-round-flat) can, for example, improve the comfort of the article and/or improve the functionality of the closure system.

A tensile strand having a plurality of cross-sectional profiles can be formed in various ways. For example, in some embodiments, the flat portions 126 and the round portions 128 can be formed as separate pieces that are coupled together with adhesive, fasteners, stitching, and/or other means for coupling. In other embodiments, the flat and round portions 126, 128 can be integrally formed as a single, continuous piece of material.

Additional information regarding tensile strands can be found, for example, in U.S. Pat. Nos. 9,113,674 and 9,681,706, which are incorporated by reference herein.

The technologies from any example can be combined with the technologies described in any one or more of the other examples. For example, one or more of the technologies described with respect to an article having the slotted eyelets 114 can be combined with one or more of the technologies described with respect to an article having the flat-round-flat tensile strands 122, or vice versa. As another example, the various technologies of any example can be separated from one or more of the other technologies of the example. For example, an article may have the slotted eyelets 114 and not the flat-round-flat tensile strands 122, or vice versa.

It should be noted that, although the exemplary embodiments are directed to articles of footwear, the disclosed technology can be adapted to various other items with laced closures systems (e.g., gloves, etc.).

In view of the many possible embodiments to which the principles of the disclosure may be applied, it should be recognized that the illustrated embodiments are only preferred examples and should not be taken as limiting the scope of the claims. Rather, the scope of the claimed subject matter is defined by the following claims and their equivalents.

The invention claimed is:

1. An article of footwear, comprising:

a sole structure;

an upper, having an outermost surface and an innermost surface defining an upper thickness, coupled to the sole structure and having a medial portion and a lateral portion;

a slotted eyelet formed in the medial portion or the lateral portion and having a major axis and a minor axis, wherein a length of the slotted eyelet along the major axis is larger than a width of the slotted eyelet along the minor axis;

an opening formed in the medial portion or the lateral portion and passing completely through the upper thickness, wherein the opening is spaced apart from the slotted eyelet and the center point of the opening is aligned with the major axis of the slotted eyelet; and a tensile strand having a first portion and a second portion, wherein the first portion is external relative to the outermost surface of the upper, extends through the opening and defines an aperture adjacent the slotted eyelet, and wherein the second portion is internal relative to the innermost surface of the upper and extends from the first portion toward the sole structure.

2. The article of footwear of claim 1, wherein the slotted eyelet is rectangular.

3. The article of footwear of claim 1, further comprising a lace member, wherein the lace member extends through the slotted eyelet and the aperture of the tensile strand, and wherein the slotted eyelet and the lace member are configured such that the lace member can move along the major axis of the slotted eyelet.

4. The article of footwear of claim 3, wherein the lace member comprises a width, and the width of the lace member is less than the length of the slotted eyelet along the major axis.

5. The article of footwear of claim 4, wherein the lace member comprises a thickness, and the thickness of the lace member is less than the width of the slotted eyelet along the minor axis.

6. The article of footwear of claim 1, wherein the opening is circular.

7. The article of footwear of claim 1, wherein the distance between the opening and the sole structure is less than the distance between the slotted eyelet and the sole structure.

8. The article of footwear of claim 1, wherein the aperture formed by the first portion of the tensile strand is a closed loop.

9. The article of footwear of claim 1, wherein the second portion of the tensile strand includes a first end and a second end, wherein the first end is spaced toward a forefoot region of the article of footwear relative to the second end.

10. The article of footwear of claim 1, wherein the second portion of the tensile strand is V-shaped.

11. The article of footwear of claim 1, wherein the first portion of the tensile strand has a first cross-sectional profile, wherein the first cross-sectional profile is circular, and the second portion of the tensile strand has a second cross-sectional profile wherein the second cross-sectional profile is rectangular.

12. The article of footwear of claim 1, wherein the slotted eyelet is one of a plurality of slotted eyelets formed in the medial and lateral portions of the upper, the opening is one of a plurality of openings formed in the medial and lateral portions of the upper, and the tensile strand is one of a plurality of tensile strands, and wherein each of the openings is disposed adjacent a respective slotted eyelet of the plurality of slotted eyelets, and the first portion of each of the tensile strands extends through a respective opening of the plurality of openings.

13. An article of footwear, comprising:

a sole structure;

an upper, having an outermost surface and an innermost surface, coupled to the sole structure and having a medial portion and a lateral portion;

a slotted eyelet formed in the medial portion or the lateral portion;

an opening formed in the medial portion or the lateral portion and extending from the outermost surface to the innermost surface of the upper, wherein the opening is spaced apart from the slotted eyelet; and a tensile strand having a first portion and a second portion, wherein the first portion is external relative to the outermost surface of the upper, extends through the opening and defines an aperture adjacent the slotted eyelet, and wherein the second portion is internal relative to the innermost surface of the upper and extends from the first portion toward the sole structure.

14. The article of footwear of claim 13, further comprising a lace member extending through the slotted eyelet and the aperture of the tensile strand, and wherein the slotted eyelet and the lace member are configured such that the lace member can move along at least one axis of the slotted eyelet.

15. The article of footwear of claim 14, wherein the lace member comprises a width, and the width of the lace member is less than a length of the slotted eyelet.

16. The article of footwear of claim 15, wherein the lace member comprises a thickness, and the thickness of the lace member is less than a width of the slotted eyelet.

17. The article of footwear of claim 13, wherein the distance between the opening and the sole structure is less than the distance between the slotted eyelet and the sole structure.

18. The article of footwear of claim 13, wherein the aperture formed by the first portion of the tensile strand is a closed loop.

19. The article of footwear of claim 13, wherein the second portion of the tensile strand includes a first end and a second end, wherein the first end is spaced toward a forefoot region of the article of footwear relative to the second end.

20. The article of footwear of claim 13, wherein the slotted eyelet is one of a plurality of slotted eyelets formed in the medial and lateral portions of the upper, the opening is one of a plurality of openings formed in the medial and lateral portions of the upper, and the tensile strand is one of a plurality of tensile strands, and wherein each of the openings is disposed adjacent a respective slotted eyelet of the plurality of slotted eyelets, and the first portion of each of the tensile strands extends through a respective opening of the plurality of openings.

* * * * *